US007310549B1

(12) United States Patent
Angelini et al.

(10) Patent No.: US 7,310,549 B1
(45) Date of Patent: Dec. 18, 2007

(54) DIVE COMPUTER WITH HEART RATE MONITOR

(75) Inventors: Sergio A. Angelini, Tennwil (CH); Jan Lichtenberg, Zürich (CH); Jari Martti Antero Tiira, Lenzburg (CH); Zivorad Antonijevic, Aarau (CH); Riku Ville Tuomas Rauhala, Wohlen (CH); Patrick André Wallimann, Apnach-Dorf (CH); Pasi Antero Lahtinen, Egliswil (CH); Thomas Hürlimann, Cham (CH); Emmanuel Glauser, St.-Légier (CH)

(73) Assignee: Johnson Outdoors Inc., Racine, WI (US)

( * ) Notice: Subject to any disclaimer, the term of this patent is extended or adjusted under 35 U.S.C. 154(b) by 0 days.

(21) Appl. No.: 11/486,463

(22) Filed: Jul. 14, 2006

(51) Int. Cl.
*A61B 5/04* (2006.01)

(52) U.S. Cl. ..... 600/509; 600/513; 482/3; 482/8; 482/9

(58) Field of Classification Search ..... 600/513
See application file for complete search history.

(56) References Cited

U.S. PATENT DOCUMENTS

| | | | | |
|---|---|---|---|---|
| 4,037,084 | A * | 7/1977 | Seireg et al. | 235/69 |
| 4,192,001 | A * | 3/1980 | Villa | 128/905 |
| 4,753,117 | A * | 6/1988 | Osterhout et al. | 73/865.1 |
| 5,301,668 | A * | 4/1994 | Hales | 128/205.23 |
| 5,392,771 | A | 2/1995 | Mock et al. | |
| 5,845,235 | A | 12/1998 | Luukkanen et al. | |
| 6,282,439 | B1 | 8/2001 | Ruha | |
| 6,321,177 | B1 * | 11/2001 | Ferrero et al. | 702/166 |
| 6,736,759 | B1 | 5/2004 | Stubbs et al. | |
| 6,745,069 | B2 * | 6/2004 | Nissila et al. | 600/523 |
| 7,190,636 | B1 * | 3/2007 | Depaola | 367/131 |
| 2005/0110765 | A1 * | 5/2005 | Baeza | 345/173 |

FOREIGN PATENT DOCUMENTS

| | | |
|---|---|---|
| EP | 1 178 374 | 2/2002 |
| GB | 2 390 903 | 1/2004 |
| WO | WO 93/00134 | 1/1993 |
| WO | WO 03/065926 | 8/2003 |
| WO | WO 2006/066098 | 6/2006 |

OTHER PUBLICATIONS

European Search Report; European Application No. EP 07 25 0141; Place of search—The Hague; Date of completion of search—Jul. 3, 2007; 2 pages.

* cited by examiner

*Primary Examiner*—Angela D. Sykes
*Assistant Examiner*—Joseph M Dietrich
(74) *Attorney, Agent, or Firm*—Reinhart Boerner Van Deuren P.C.

(57) ABSTRACT

A dive computer that includes heart rate monitoring capability is provided. The heart rate monitoring is accomplished by a belt that fits around the diver's chest, and the information is wirelessly transmitted to the dive computer. The heart rate information may be displayed during and after a dive, and the dive computer may selectively utilize the monitored heart rate information to compensate the decompression algorithm based on workload during the dive. The dive computer can also utilize the monitored heart rate information to compensate the decompression algorithm based on workload on the surface before and/or after the dive for no fly and repetitive dive calculations.

20 Claims, 7 Drawing Sheets

DIVE COMPUTER WITH HEART RATE MONITOR

FIELD OF THE INVENTION

This invention generally relates to heart rate monitors, and more particularly to wearable athletic computers having heart rate monitoring and calculation capabilities.

BACKGROUND OF THE INVENTION

Heart rate monitors are popular among athletes but more and more people at all fitness levels are starting to use them as an additional and important tool to monitor their health and the impact of their exercise schedule on their well being. Manufacturers of such heart rate monitors offer various models having differing configurations and functions, many designed and marketed for specific sporting activities such as running, cycling, etc.

A typical hear rate monitor consists of a watch worn on the user's wrist, and a heart rate detector that is worn against the user's skin around the chest. The detector is often embodied in a belt that may be adjusted to fit comfortably around the user's chest. The detector includes electrocardiogram (EKG) electrodes that are able to detect the electrical signals from the user's heart. These signals are then wirelessly transmitted to the watch worn on the user's wrist by a transmitter included in the detector. This watch typically includes a processor that converts these signals into a heart rate number and a display on which the heart rate number is displayed, preferably continuously. One such hear rate is described in U.S. Pat. No. 6,282,439, entitled Method of Measuring Vital Function and Measuring Device, assigned to Polar Electro Oy.

While current heart rate monitors are used by and marketed to athletes to provide them with information regarding their intensity of exercise or exertion level so that the athletes can train and compete at an optimum level, such heart rate monitors do little more than display a heart rate number for the user to look at. Some more complex heart rate monitors can also measure altitude and ascent, and can associate the monitored heart rate with this information to provide the user with a graphic illustration of this information so that the user can, later, review how his or her heart rate varied during the various periods of exertion during the training session. While this information is informative to the user and while the user can review this information to see if his or her overall level of fitness appears to be improving (e.g. by observing a sustained pace with a heart rate that is lower than previously observed by the user at the same pace), the heart rate monitor does not actually utilize this information for any health related calculations. Some heart rate monitors do provide an alarm that sounds when the monitored heart rate exceeds a user set maximum heart rate. However, this alarm is again merely informational and is not adjusted or varied when other parameters change, such as altitude, even though the level of exertion and effect on the body may well be affected by such other parameters.

One such sporting activity in which careful monitoring of exertion level changes are critically important is scuba diving, since inert gas uptake and elimination (which can lead to decompression sickness) are strongly affected by blood circulation. While many scuba divers wear a dive computer during a dive to monitor dive time, depth, etc. and to calculate appropriate decompression stops during ascent, etc., currently there are no dive computers that include a heart rate monitor.

There exists, therefore, a need in the art for a diving computer that includes a heart rate monitor that not only monitors and displays heart rate information, but that can utilize this monitored heart rate information in calculations towards diver safety. The invention provides such a dive computer. These and other advantages of the invention, as well as additional inventive features, will be apparent from the description of the invention provided herein.

BRIEF SUMMARY OF THE INVENTION

In view of the above, it is an object of the present invention to provide a new and improved dive computer. More particularly, it is an object of the present invention to provide a new and improved dive computer that includes heart rate monitoring capability. Still more particularly, it is an object of an embodiment of the present invention to provide a new and improved dive computer that utilizes the monitored heart rate information to compensate the decompression algorithm based on workload during the dive. Further, it is an object of an embodiment of the present invention to provide a new and improved dive computer that utilizes the monitored heart rate information to compensate the decompression algorithm based on workload on the surface before and/or after the dive for no fly time, i.e. the minimum amount of time that the diver should wait before taking a plane due to the low pressure in modern aircraft cabins, and repetitive dive calculations.

In one embodiment of the present invention, a dive computer includes a heart rate detector that includes a wireless transmitter that is worn by the diver to detect the diver's heart rate. The heart rate detector may be a wearable belt that fits around the user's chest, wrist, or other appropriate area of the body to detect the heart rate. Preferably, the heart rate detector includes EKG electrodes that detect the heart's electrical signals. The diving computer may be mounted on a wrist band, on a console that also carries other instruments, on a writing slate attached to the diving vest, integrated with a diving mask, etc. The transmitter in the heart rate detector wirelessly transmits the heart rate information to the dive computer. The dive computer includes a display screen on which the heart rate information may be displayed. This display screen may be an LCD display, a dot matrix display, etc. Preferably, the dive computer provides a user selectable feature to enable and disable the heart rate monitoring. In another embodiment of the present invention, the heart rate information may be displayed in the water during the dive and/or on the surface before and/or after the dive. The heart rate information may be displayed in real time, continuously or at a sampled rate, and/or as a historical representation, alone or in correlation with other dive information, e.g. depth.

In another embodiment of the present invention, the dive computer utilizes the heart rate information to compensate the decompression algorithm for increased and/or decreased blood flow indicated by increased and/or decreased heart rate during the dive. In another embodiment, the dive computer also utilizes monitored heart rate information after a dive to compensate the decompression algorithm, particularly in calculations for repetitive dives. In another embodiment the dive computer utilizes the heart rate information to compensate the calculation of a no fly time.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
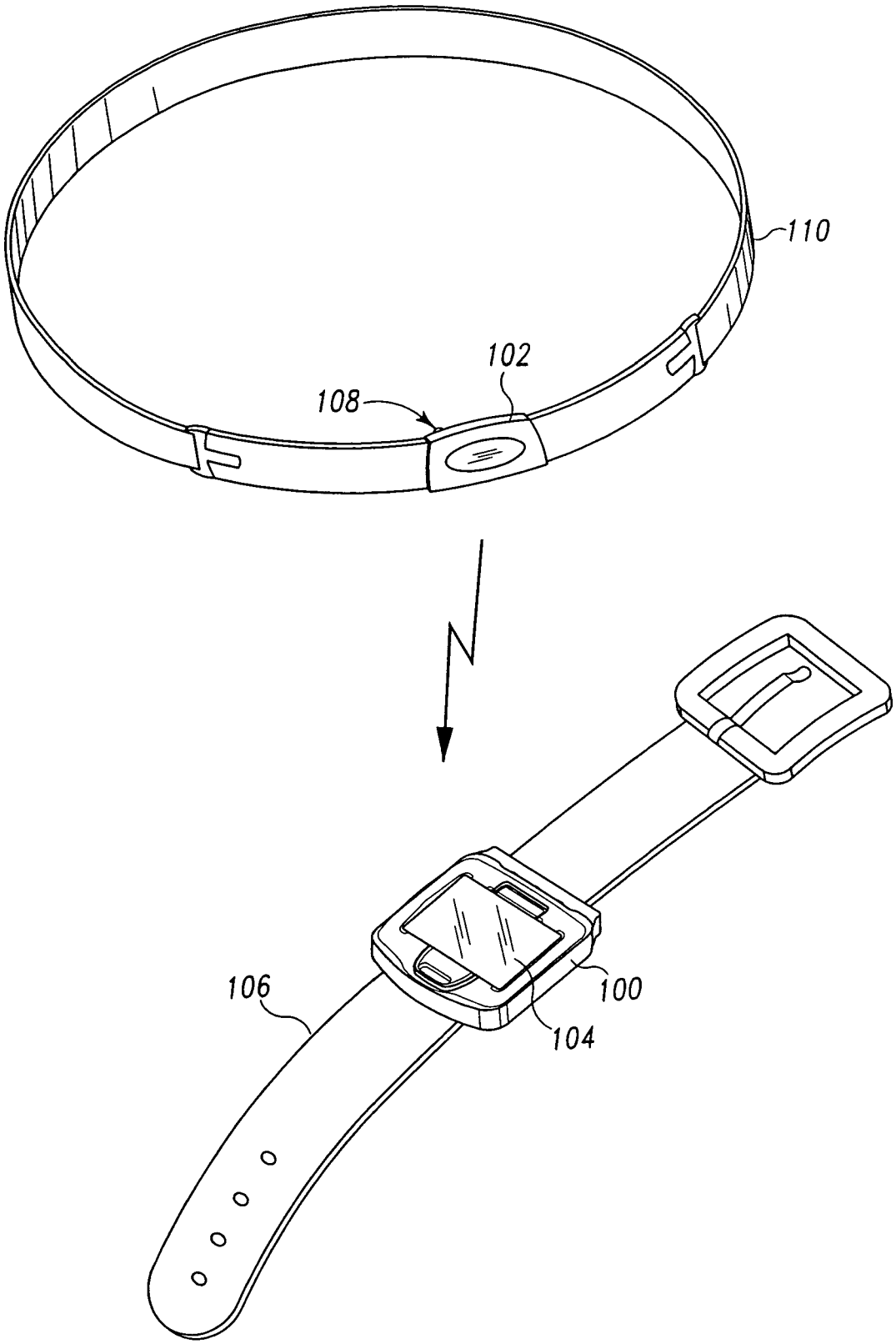
FIG. 1 illustrates one embodiment of a dive computer of the present invention having heart rate monitoring functionality.
Figure 9:
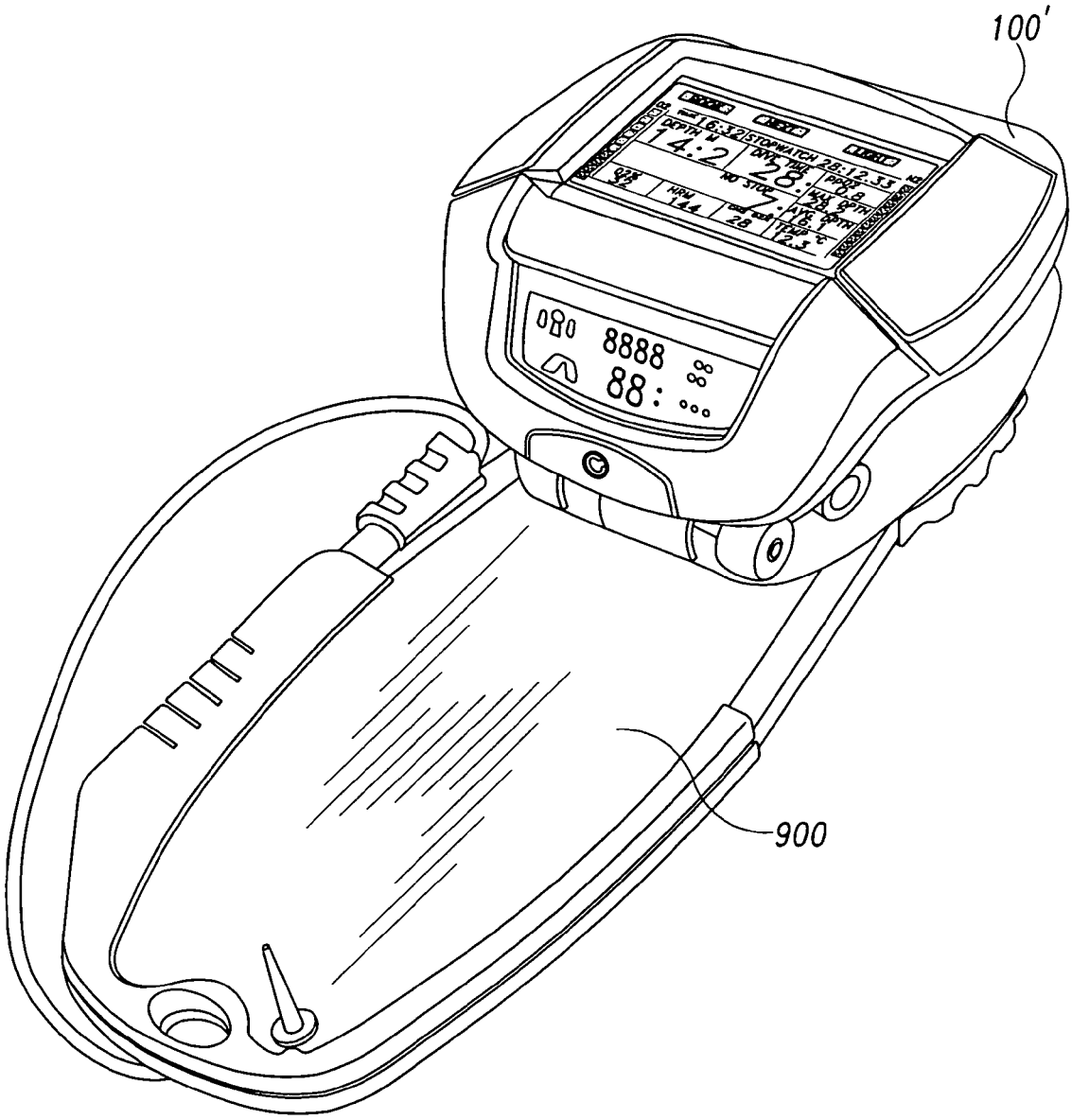
FIG. 9 illustrates an alternate mounting arrangement for an embodiment of the dive computer of the present invention on a writing slate.
Figure 10:
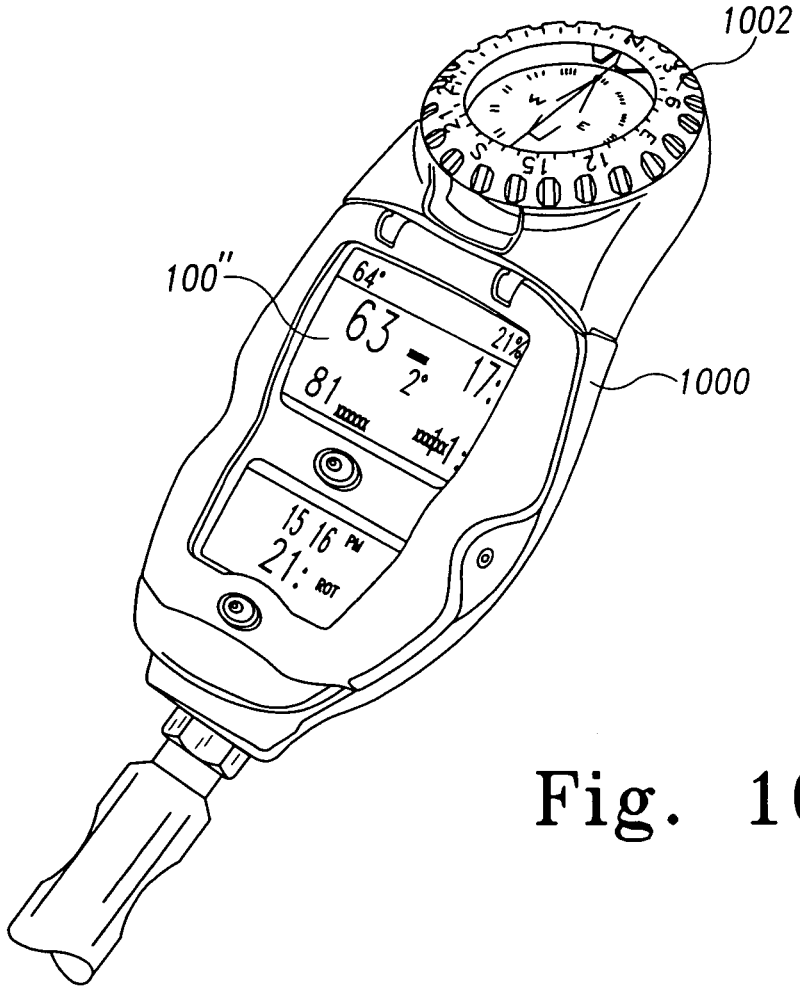
FIG. 10 illustrates an alternate mounting arrangement for an embodiment of the dive computer of the present invention on an instrument console.
Figure 11:
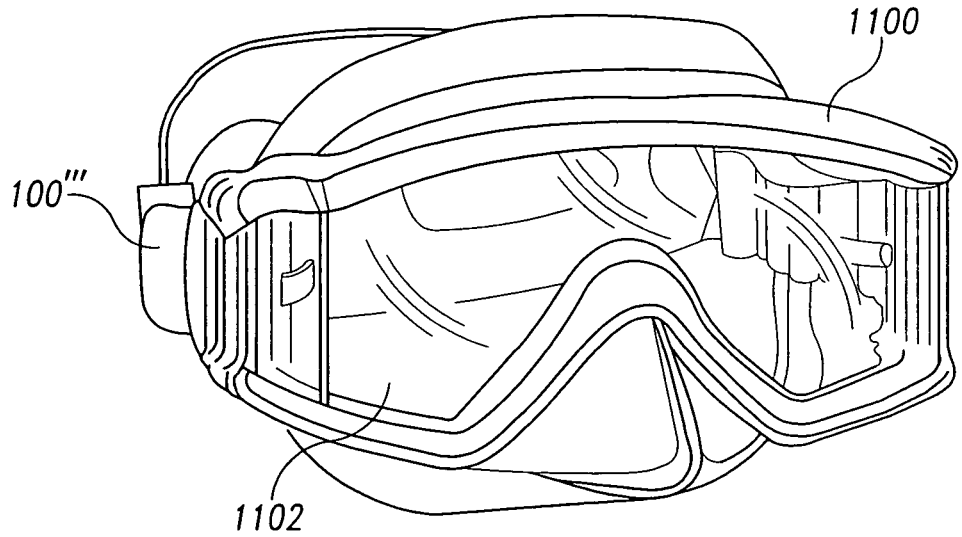
FIG. 11 illustrates an alternate mounting arrangement for an embodiment of the dive computer of the present invention integrated into a diving mask.

Scuba diving is an activity that requires a certain level of exertion, although in general not to the extent of jogging, bicycling or other very aerobic activities. Still, it is of interest to see how the body reacts to the underwater environment and to the stress of diving. In addition, exertion level directly affects inert gas uptake and elimination, and as such has an influence on safe ascent schedules (recommended decompression stops). As such, one embodiment of the present invention, as illustrated in FIG. 1, provides a diving computer system that includes a dive computer 100 with heart rate monitoring functionality. The diving computer 100 may be mounted on a wrist band 106 as illustrated in FIG. 1, or in other embodiments it may be mounted on a writing slate 900 attached to the diving vest as illustrated in FIG. 9, on a console 1000 that also carries other instruments 1002 as illustrated in FIG. 10, or integrated with a diving mask 1100 that utilizes the lens 1102 to display information to the diver, etc.

The system also includes a heart rate detector 102 that is worn against a user's skin, such as around the chest, wrist, or other appropriate location to pick up the heart beat information. Preferably, the diver wears the heart rate detector 102 so that the electrodes 108 contact the skin on the chest. In a preferred embodiment, the heart rate detector 102 is a chest transmitter belt 110 manufactured by Polar Electro Oy. The detected information is then wirelessly transmitted from a transmitter in the heart rate detector 102 to the dive computer 100 wherein the information is converted to a heart rate. Alternatively, the heart rate detector 102 calculates the heart rate and transmits the calculated heart rate to the dive computer 100 for use therein. While a preferred embodiment utilizes a wireless transmitter within the heart rate detector 102, one skilled in the art will recognize from the foregoing that the heart rate information may also be communicated to the dive computer 100 via a wired interface or may be integrated in the dive computer 100.

Figure 2:
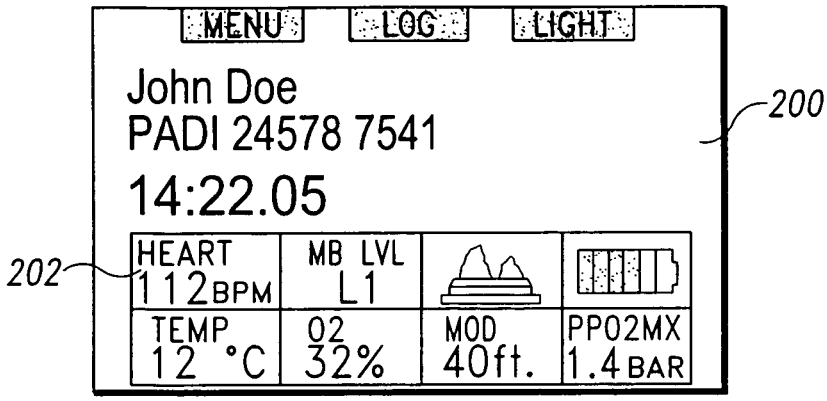
FIG. 2 is an exemplary screen shot of a surface display for an embodiment of the dive computer of the present invention including, among other, heart rate information.
Figure 3:
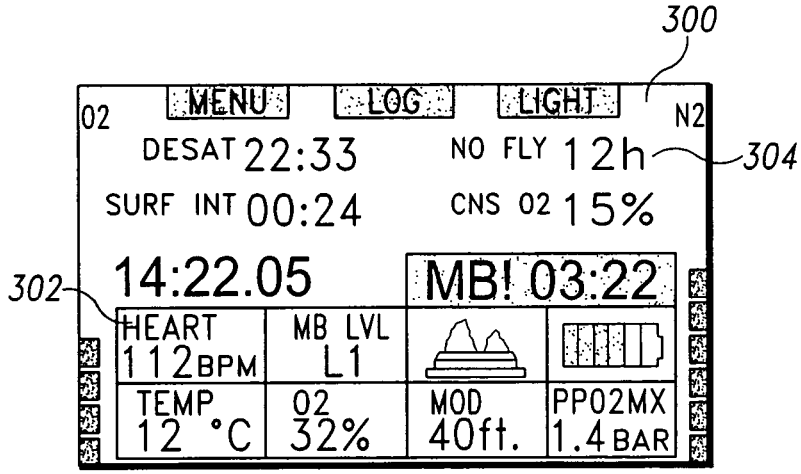
FIG. 3 is an exemplary screen shot of a surface display for an embodiment of the dive computer of the present invention including, among other, heart rate and no fly time information.
Figure 5:
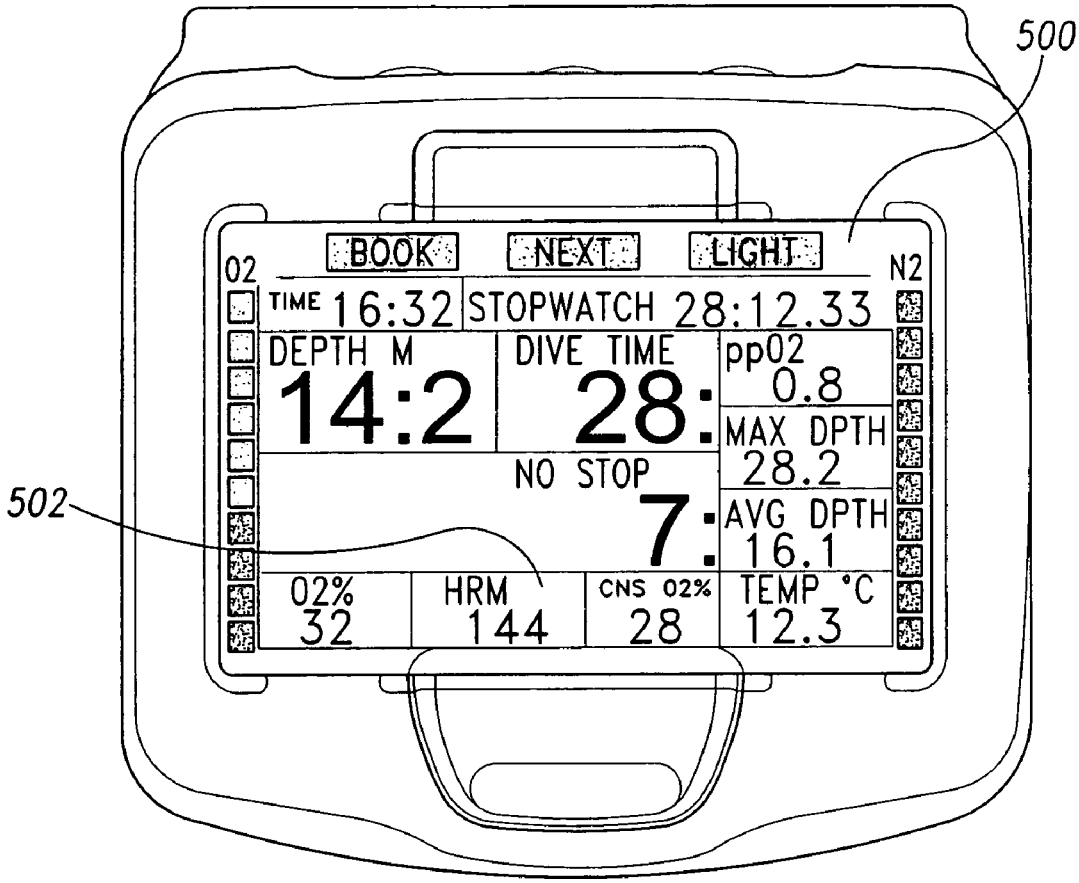
FIG. 5 is an exemplary screen shot of a diving display for an embodiment of the dive computer of the present invention including, among other, heart rate information.
Figure 6:
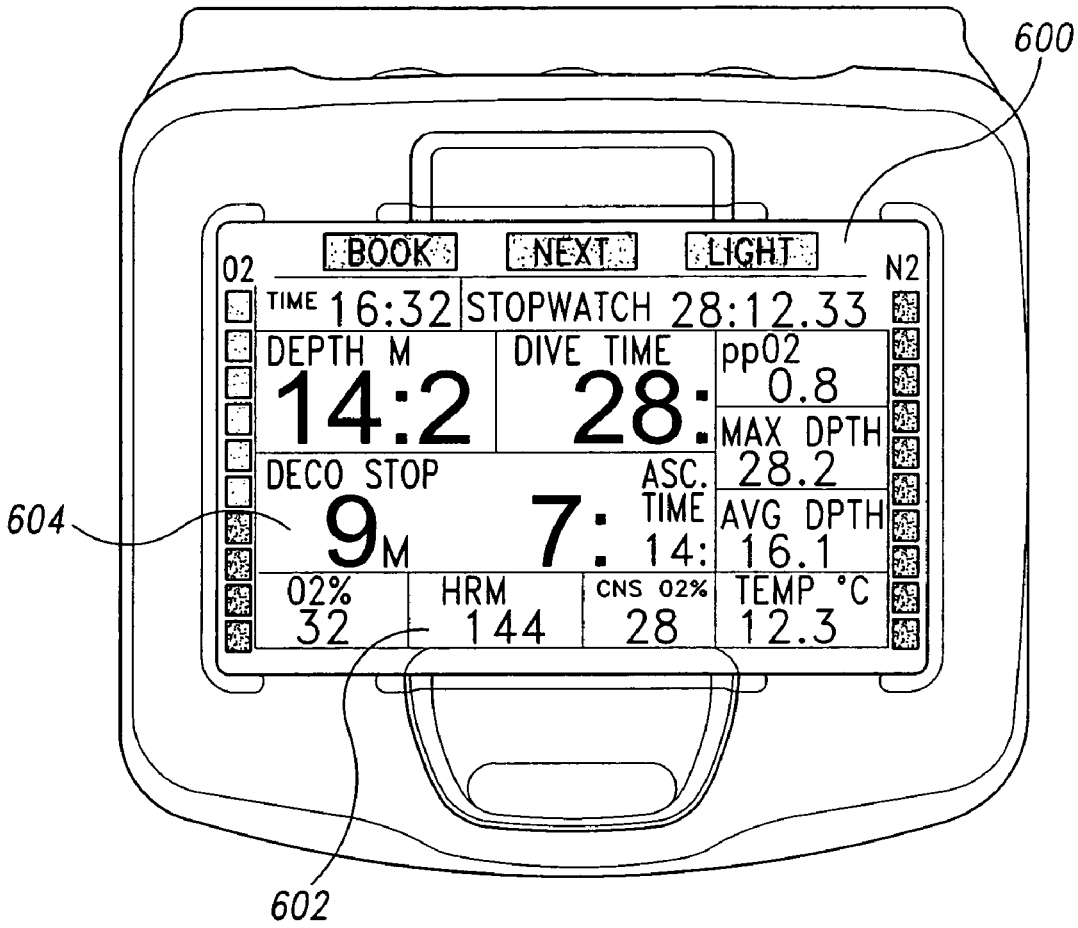
FIG. 6 is an exemplary screen shot of a diving display for an embodiment of the dive computer of the present invention including, among other, heart rate information and decompression stop information.

The heart rate information may then be displayed on the display screen 104 of the dive computer 100 on the surface, such as on surface displays 200 and 300 illustrated in FIGS. 2 and 3, respectively, and/or during the dive as illustrated on diving displays 500 and 600 illustrated in FIGS. 5 and 6, respectively. In both the surface displays 200 and 300 and the dive displays, the monitored heart rate is displayed in beats per minute (BPM) in an area (202, 302, 502, 602) of the display. This display screen 104 may be an LCD display, a dot matrix display, etc.

As described in co-pending application Ser. No. 11/451,042, filed Jun. 12, 2006, entitled Diving Computer With Programmable Display and assigned to the assignee of the present invention, the teachings and disclosure of which is hereby incorporated in the entireties by reference hereto, the user is able to choose how and where, if at all, this heart rate information is displayed on screen 104 in embodiments of the present invention. In other embodiments, the positioning of the heart rate information is pre-programmed.

Monitoring the heart rate during a dive provides information to the diver as to whether he/she should maybe slow down or relax more (high heart rate is linked to higher workload, and higher workload implies increased breathing, which in turn means the diver will be accelerating the depletion of breathing gas reserve in the scuba tank). Or, in presence of a strong current to overcome, the heart rate would indicate to the diver whether he/she has additional reserve for fighting the current or not. These determinations can be made by the user by simply observing the heart rate information displayed on the display screen 104 during the dive (see, e.g. FIGS. 5-6).

As will be discussed more fully below, in some embodiments of the present invention the dive computer 100 may also use this heart rate information in its various diver safety related calculations. In an embodiment, the choice of whether to use such heart rate monitored information in such calculations is user selectable from the programming display 400 of FIG. 4. From this programming screen 400, the diver may select the heart rate (HR) monitor to be on for display only (ON), i.e. without workload compensation, on with workload compensation (ON+WL) or off (OFF) via field 402. To allow the dive computer to assess the influence of a given change in the heart rate information to properly compensate, e.g. the decompression calculations, the diver would also enter his or her maximum heart rate via field 404 and resting heart rate via field 406. If this information is not entered, then the computer will simply display the diver's heart rate on the various displays, but will not use this information to compensate the decompression algorithm.

Once programmed via screen 400, the user's heart rate information will be both displayed for the user's information and the dive computer will use this information to calculate various safety related parameters related to the body's ongassing and offgassing during and after the dive. That is, in diving the exposure to higher than atmospheric ambient pressure implies that a diver will absorb nitrogen from the compressed air/nitrox that the diver is breathing (in the case of heliox, it is helium that is absorbed and in the case of trimix it is both nitrogen and helium). This absorption process leads to accumulation of nitrogen in muscles, tissues, etc. During the ascent and upon returning to the surface, and hence to a reduced ambient pressure, the process is reversed and muscle, tissues etc. will offgas the excess nitrogen. The nitrogen ongassing and offgassing are the controlling elements for the decompression calculations carried out by the dive computer 100.

Both ongassing and offgassing are a function of the circulation of the blood in the body, and will increase in presence of increased blood flow. In the absence of information about the blood flow, a dive computer 100 must assume a constant blood flow and is therefore unable to allow for changes due to increased exertion during the dive. Some dive computers manufactured by the assignee of the instant application use tank information, i.e. the pressure drop associated with each breath, to determine an increase in workload and hence allow for increased circulation in the decompression calculation. However, such requires that the dive computer be directly integrated with the tank pressure measurement, which is more costly. Such dive computers that are not integrated with the tank must use a constant workload throughout the dive and therefore cannot adapt the ongassing and offgassing calculations due to increased workload. The dive computer 100 of the present invention that includes heart rate monitoring functionality, however, can now include such information in the calculations during the dive, even in the absence of tank information.

Moreover, recent studies have shown that increased blood flow after a dive (due to something as simple as walking back to the car after the dive while donning the equipment) can also play an important role in the safety of divers. This is because any change in circulation of the diver will affect the offgassing rate. Depending on the decompression stress present in the diver's body at the time of exercise on the surface after a dive, exercise can either promote inert gas bubble formation (a negative effect) or promote inert gas elimination (a positive effect). In the case of a dive requiring significant decompression stops, an increase in exercise level after the dive could potentially promote inert gas bubble formation which could lead to decompression sickness. In any case, a change in the offgassing level due an increase of circulation is relevant for repetitive diving and for calculation of the no fly time. Such a no fly time may be illustrated, e.g., on the surface display 300 in field 304.

In an embodiment of the present invention, the dive computer 100 continues to receive the heart rate information after the dive so that it can be aware of this change of conditions. This allows the dive computer of the present invention to correctly calculate the decompression in a repetitive dive. This is only possible with the dive computer 100 of the present invention having the heart rate detector 102. Such calculations are not possible with the gas integrated computers (monitoring tank pressure) because the diver would not be breathing off the tank on the surface. As such, the gas integrated computers are oblivious to changes in offgassing brought on by changes in circulation due to activity on the surface when the diver is not breathing from the tank.

In one embodiment, the dive computer 100 of the present invention utilizes the Bühlmann ZH-L8 ADT mathematical model. This model allows the dive computer 100 to adapt to actual diver behaviors and other environmental conditions. The name of the model was derived from ZH-Zurich where the model was developed, L8 refers to the number of body tissue groups that the model considers and ADT is short for adaptive. With an adaptive model, if a diver exceeds the prescribed ascent rate, works too hard as determined by the monitored heart rate, or is exposed to really cold water, the dive computer 100 may ask the diver to complete a compensation decompression stop as indicated, e.g. in field 604 of FIG. 6 during the dive. Another advantage of the adaptive model is that it allows the dive computer 100 to more accurately predict the remaining gas requirements on dives and it provides more accurate monitoring of the CNS loading for Nitrox divers.

As discussed above, some dive computer models assume an average workload throughout the dive. However, an unfit diver, for example, will breathe more heavily during a dive at depth than a fit diver. Even fit divers sometimes find themselves working hard in situations such as swimming against a current or removing an anchor that is stuck under a rock. In such high workload circumstances the diver can absorb more nitrogen, particularly in the muscle tissue groups. This additional uptake of nitrogen, in turn, is exposing the diver to a greater risk of microbubble formation and the possibility of decompression sickness.

Figure 4:
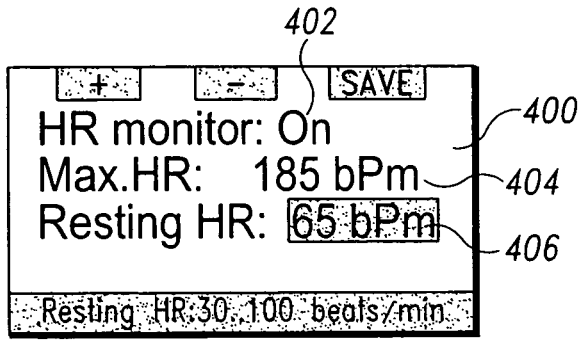
FIG. 4 is an exemplary screen shot of a programming display for an embodiment of the dive computer of the present invention to enable heart rate monitoring and decompression calculation compensation.

The dive computer 100 of the present invention takes into account that different divers have different levels of fitness and different levels of exertion on different dives via the information entered by the diver via programming screen 400 of FIG. 4 and the monitored heart rate during the dive. The dive computer 100, sensing such conditions via the monitored heart rate, can actually influence a diver who is working hard, to reduce the level of exertion, by relaxing and breathing more slowly. If a diver persists in working hard at depth the dive computer 100 of the present invention may ask the diver to complete an additional decompression stop (see, e.g., field 604 of FIG. 6). For example, earlier mathematical models assumed a mean workload output of 50 W. With the ZH-L8 ADT MB model, if workload is increased to 85 W, the total decompression time for a particular dive can increase from 30 to 60 minutes.

In one embodiment of the present invention, this workload compensation uses the heart-rate data acquired during the dive to adapt the decompression and dive-safety analysis performed by the dive computer to the actual workload of the diver. To make this compensation, the dive computer establishes classifications of the heart rate in discrete bins using a physiologically relevant classification method. In one embodiment, 8 bins or classifications of workload are used. A preferred method utilizes linear binning of the difference between maximum heart rate and resting heart rate, i.e. this difference is divided by the number of bins used, e.g. 8, to generate the workload classes or bins. In an alternate embodiment, exponential binning is used. Since the maximum heart rate and the resting heart rate parameters depend on the age and fitness of the diver, the compensation is thus specific for a person. In one embodiment, the dive computer deducts a certain amount from the specified maximum heart rate before performing the binning (e.g. 20%) to reflect the fact that underwater the body does not quite reach the highest maximum heart rate (as much as the maximum heart rate in biking is lower than in jogging).

Once the bins or classifications are established by the dive computer, the raw heart-rate data is first filtered by removing erroneous data points that may have resulted from sudden jumps to heart rate which are quickly recovered (and have no effect on gas uptake or elimination), followed by low-pass filtering of the remaining data set. In embodiments of the present invention, 4 to 16 samples are used for filtering, counted either equally or using a weighted function, although other embodiments may use more or fewer samples. Finally, the classified workload data is low-pass filtered again. In one embodiment, the dive computer averages the heart rate over a given time, e.g. 1 minute, to obtain the correct workload bin or classification for this interval. When the result is such that it fits into a higher workload class, the decompression algorithm is adjusted accordingly. This is done by changing the half times of the compartments used in the decompression model. Since every compartment is defined by a half time, which basically determines how quickly a compartment loads and eliminates nitrogen, changing the half time can simulate the increase or decrease of blood flow. In this model a shorter half time is equivalent to more blood flow through the compartment and a longer half time is equivalent to less blood flow.

The heart rate reflects the physiological as well as the psychological stress level of the diver. A rapid increase of the heart rate can be interpreted as a sudden stress, maybe due to a physiological condition, such as a cramp, or a psychological stress, such as the loss of orientation or an equipment problem. Thus, heart-rate monitoring can help to identify these situations by careful analysis of changes in the beat pattern and of other sensory inputs. The resulting information can not only be used to adjust decompression advice as discussed above, but it may also be used in embodiments of the present invention to alert the diver's dive buddy to such situations. This alerting function may be accomplished by the dive computer of the present invention using a suitable communication link to the dive buddy's dive computer, e.g. Bluetooth or other wireless technology. The dive computer of the dive buddy then displays a warning message alerting the dive buddy to the stress situation.

Figure 7:
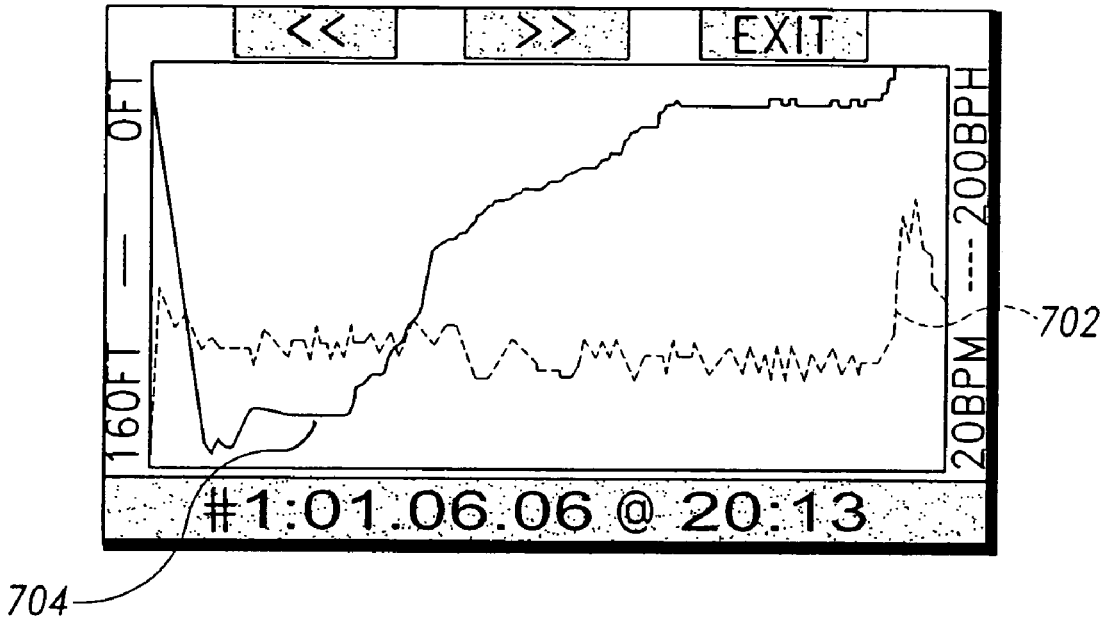
FIG. 7 is an exemplary screen shot of a graphical trend display for an embodiment of the dive computer of the present invention correlating a historical heart rate during a dive with the depth information during the dive.
Figure 8:
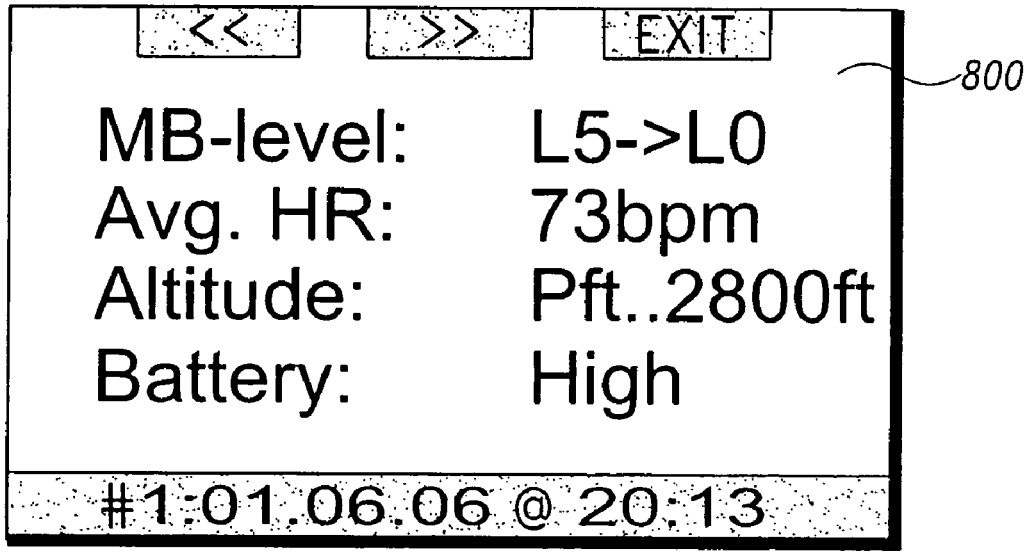
FIG. 8 is an exemplary screen shot of a log screen for an embodiment of the dive computer of the present invention illustrating information logged during a dive.

Additionally, embodiments of the present invention also provide calculations for and/or display further exercise data. Such data may be viewed during and/or after a dive. For example, as illustrated in FIG. 7, the dive computer 100 can correlate the monitored heart rate information 702 with the depth information 704 and display a graph of these parameters for the diver on the display screen 104. Log screen 800 illustrated in FIG. 8 provides information of the time in and out, the average heart rate, etc. for the diver's information. In embodiments of the present invention that include a PC interface, the diver can also review the heart rate information on his or her PC after the dive. Other log screens may also be provided in embodiments of the present invention to display, e.g. minimum and maximum heart rate, energy (calories) burned during the dive, etc. as is known with land-based heart rate monitors.

Communication between the dive computer 100 and the heart rate detector 102 consumes energy, albeit little. In addition, memory space in the dive computer 100 is used by logging the heart rate information. To reduce the energy consumption and memory usage, the heart rate can be sampled at a less than continuous rate. In one embodiment, the sampling is performed at a 4 second sampling rate. To further preserve battery energy and memory usage, the diver can set the heart rate monitor function to OFF via programming screen 400 (see FIG. 4) if he or she is not going to use this feature.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A diving computer system, comprising:

a dive computer having a display screen on which information is displayed;

a heart rate detector in communication with the dive computer, the heart rate detector being wearable by a user and operable to detect a heart beat thereof, the heart rate detector further being operative to transmit information to the dive computer indicative of the heart beat;

wherein the dive computer receives the information transmitted from the heart rate detector and converts the information into a heart rate of the user; and wherein the dive computer utilizes a decompression algorithm to calculate decompression stops, and wherein the dive computer utilizes the heart rate of the user to compensate the decompression algorithm for actual user workload to vary the decompression stops.

2. The system of claim 1, wherein the heart rate detector is a wearable belt including electrocardiogram electrodes positioned to contact skin of the user when the belt is worn by the user.

3. The system of claim 2, wherein the wearable belt is an adjustable chest belt and includes a wireless transmitter operative to wirelessly transmit the information to the dive computer.

4. The system of claim 1, further comprising a wrist band operatively coupled to the dive computer to allow the dive computer to be worn on the wrist of the user.

5. The system of claim 1, further comprising a console including a plurality of instruments, the dive computer being operative housed therein.

6. The system of claim 1, further comprising a writing slate configured to be attached to a diving vest, the writing slate operatively coupled to the dive computer.

7. The system of claim 1, wherein the dive computer is integrated with a diving mask, and wherein the display screen is provided by a lens thereof.

8. The system of claim 1, wherein the dive computer displays the heart rate of the user on the display screen.

9. The system of claim 8, wherein the heart rate detector transmits the information to the dive computer continuously.

10. The system of claim 9, wherein the heart rate detector transmits the information to the dive computer periodically.

11. The system of claim 10, wherein the heart rate detector transmits the information to the dive computer approximately every four seconds.

12. The system of claim 1, wherein the dive computer is configured to allow the user to enable and disable heart rate monitoring.

13. The system of claim 1, wherein the dive computer is configured to allow the user to enable and disable compensation of the decompression algorithm.

14. The system of claim 13, wherein the dive computer is configured to utilize the user's maximum heart rate and resting heart rate programmed by the user, along with the heart rate, to determine the actual user workload.

15. The system of claim 1, wherein the dive computer utilizes the decompression algorithm to calculate a no fly time, and wherein the dive computer utilizes the heart rate of the user to compensate the decompression algorithm to vary the no fly time.

16. The system of claim 1, wherein the dive computer continues to utilize the heart rate of the user on the surface after the user has completed a dive to compensate the decompression algorithm.

17. The system of claim 1, wherein the dive computer broadcasts a stress warning signal when the heart rate of the user exceeds a threshold.

18. A diving computer system, comprising:

a dive computer programmed with a decompression algorithm to calculate decompression stops suggested during a dive;

a heart rate detector in communication with the dive computer; and wherein the dive computer compensates the decompression algorithm to vary the decompression stops suggested during the dive based on an actual monitored heart rate of a user.

19. The diving computer system of claim 18, wherein the heart rate detector is operative to continue to monitor a heart rate of a user after the dive is over, and wherein the dive computer continues to compensate the decompression algorithm based on the actual monitored heart rate of the user after the dive is over.

20. A method of calculating decompression stops during an underwater dive, comprising the steps of:

monitoring a heart rate of a diver;

calculating an actual workload of the diver based on the heart rate; and compensating a decompression algorithm to vary the decompression stops based on the actual workload of the diver.

* * * * *